US011028342B2

(12) United States Patent
Piorkowski et al.

(10) Patent No.: US 11,028,342 B2
(45) Date of Patent: Jun. 8, 2021

(54) USE OF AN IONIC LIQUID AND ALCOHOL BLEND TO MODIFY THE RHEOLOGY OF POLYETHOXYLATED ALCOHOL SULFATES

(71) Applicant: Henkel IP & Holding GmbH, Duesseldorf (DE)

(72) Inventors: Daniel Thomas Piorkowski, Fairfield, CT (US); David S. Stott, II, Madison, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 52 days.

(21) Appl. No.: 15/831,500

(22) Filed: Dec. 5, 2017

(65) Prior Publication Data

US 2019/0169535 A1 Jun. 6, 2019

(51) Int. Cl.

*C11D 1/00* (2006.01)
*C11D 1/831* (2006.01)

(Continued)

(52) U.S. Cl.

CPC ..... *C11D 1/831* (2013.01); *C11D 1/29* (2013.01); *C11D 3/2006* (2013.01); *C11D 3/30* (2013.01); *C11D 3/3409* (2013.01); *C11D 3/3463* (2013.01); *C11D 11/0017* (2013.01); *C11D 17/042* (2013.01); *C11D 1/123* (2013.01); *C11D 1/146* (2013.01); *C11D 1/62* (2013.01); *C11D 1/72* (2013.01); *C11D 3/201* (2013.01);

(Continued)

(58) Field of Classification Search

CPC .. C11D 1/831; C11D 1/29; C11D 3/30; C11D 3/2006; C11D 3/3463

See application file for complete search history.

(56) References Cited

U.S. PATENT DOCUMENTS 4,092,273 A * 5/1978 Inamorato ..... C11D 1/72 510/325
6,037,319 A 3/2000 Dickler et al.

(Continued)

FOREIGN PATENT DOCUMENTS

WO 2004003120 A2 1/2004
WO 2006050298 A2 5/2006

(Continued)

OTHER PUBLICATIONS

PCT International Search Report PCT/US2018/063974 dated May 21, 2019 3 pages.

*Primary Examiner* — Necholus Ogden, Jr.
(74) *Attorney, Agent, or Firm* — Bojuan Deng

(57) ABSTRACT

In one embodiment, a polyethoxylated alcohol sulfate composition is provided which includes a polyethoxylated alcohol sulfate, such as sodium laureth ether sulfate (SLES), water, an ionic liquid, and an alcohol. The ionic liquid and the alcohol form a synergistic blend, enabling a significant reduction of the viscosity of the polyethoxylated alcohol sulfate composition. Also provided is an embodiment of a method for modifying the rheology of polyethoxylated alcohol sulfate by use of an ionic liquid and alcohol blend. Finally provided is an embodiment of a detergent composition which is prepared by use of the polyethoxylated alcohol sulfate composition described herein, in addition to other commonly known ingredients.

20 Claims, 1 Drawing Sheet

(51) Int. Cl.

| | |
|---|---|
| ***C11D 3/34*** | (2006.01) |
| ***C11D 11/00*** | (2006.01) |
| ***C11D 17/04*** | (2006.01) |
| ***C11D 1/29*** | (2006.01) |
| ***C11D 3/30*** | (2006.01) |
| ***C11D 3/20*** | (2006.01) |
| *C11D 1/72* | (2006.01) |
| *C11D 1/14* | (2006.01) |
| *C11D 1/12* | (2006.01) |
| *C11D 1/62* | (2006.01) |

(52) U.S. Cl.
CPC ..... *C11D 3/2013* (2013.01); *C11D 3/2017* (2013.01); *C11D 11/0094* (2013.01)

(56) References Cited

U.S. PATENT DOCUMENTS

| | | | | |
|---|---|---|---|---|
| 7,259,134 | B2 | 8/2007 | Beckholt et al. | |
| 2003/0114332 | A1 | 6/2003 | Ramcharan et al. | |
| 2005/0101505 | A1 | 5/2005 | Wood | |
| 2006/0094617 | A1 | 5/2006 | Price et al. | |
| 2006/0094620 | A1 | 5/2006 | Jordan, IV et al. | |
| 2006/0166856 | A1 | 7/2006 | Petrat et al. | |
| 2011/0112005 | A1 | 5/2011 | Brooker et al. | |
| 2012/0058151 | A1 | 3/2012 | Ferreiro et al. | |
| 2012/0135910 | A1 | 5/2012 | Gross et al. | |
| 2013/0324455 | A1 | 12/2013 | Blattner et al. | |
| 2014/0083465 | A1* | 3/2014 | D'Ambrogio ..... | C11D 3/28 134/22.19 |
| 2014/0274859 | A1 | 9/2014 | Adamy | |
| 2015/0210957 | A1 | 7/2015 | Napolitano | |
| 2016/0177222 | A1 | 6/2016 | Bianchetti et al. | |
| 2016/0376522 | A1 | 12/2016 | Bianchetti et al. | |
| 2017/0283748 | A1* | 10/2017 | Caires ..... | C11D 3/43 |
| 2019/0085273 | A1* | 3/2019 | Gutowski ..... | C11D 3/349 |

FOREIGN PATENT DOCUMENTS

| | | | |
|---|---|---|---|
| WO | 2015164515 | A1 | 10/2015 |
| WO | 2016040629 | A1 | 3/2016 |

* cited by examiner

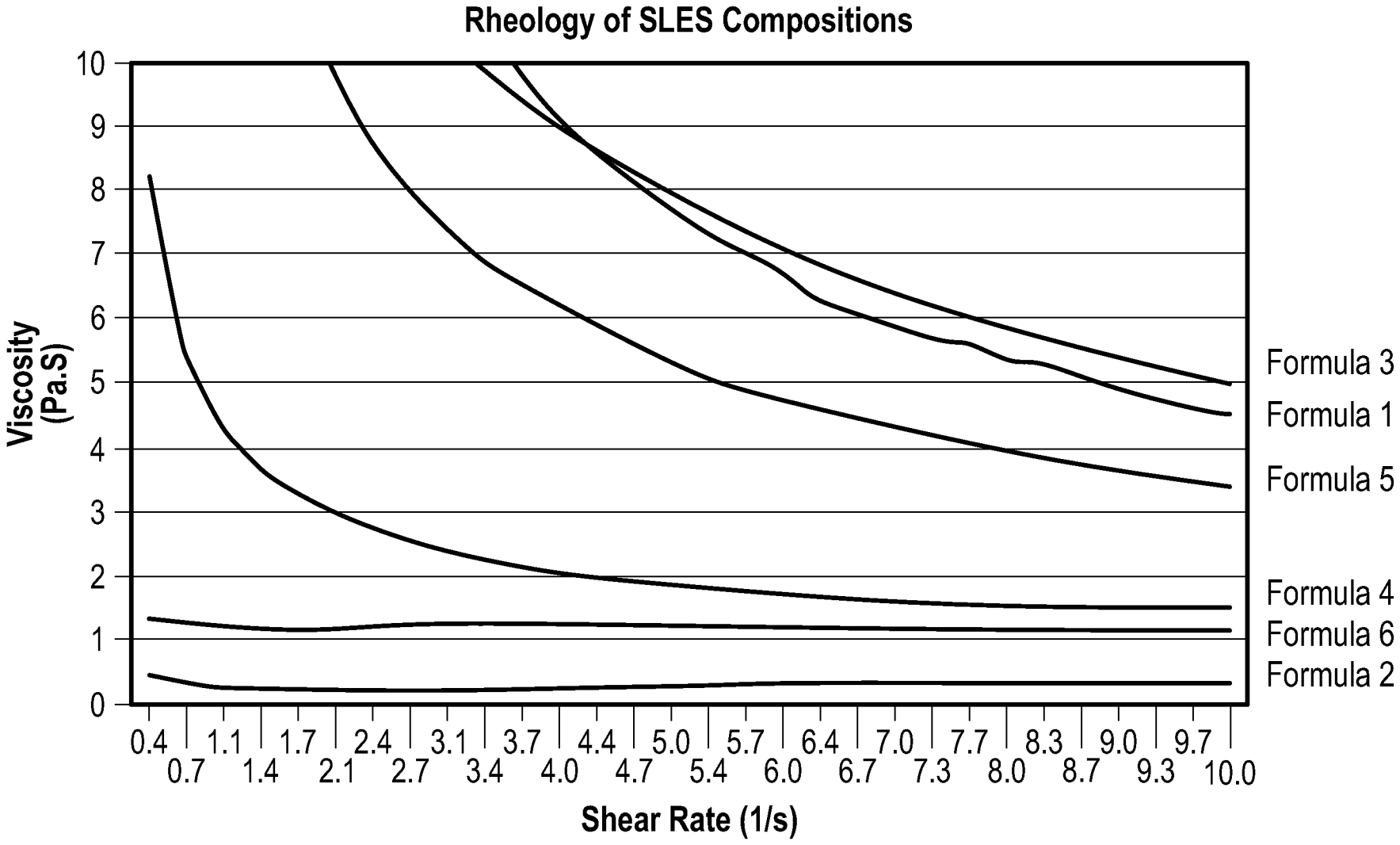
Rheology of SLES Compositions
Viscosity (Pa.S)
0
1
2
3
4
5
6
7
8
9
10
Shear Rate (1/s)
0.4
0.7
1.1
1.4
1.7
2.1
2.4
2.7
3.1
3.4
3.7
4.0
4.4
4.7
5.0
5.4
5.7
6.0
6.4
6.7
7.0
7.3
7.7
8.0
8.3
8.7
9.0
9.3
9.7
10.0
Formula 3
Formula 1
Formula 5
Formula 4
Formula 6
Formula 2

USE OF AN IONIC LIQUID AND ALCOHOL BLEND TO MODIFY THE RHEOLOGY OF POLYETHOXYLATED ALCOHOL SULFATES

FIELD OF THE INVENTION

The present invention relates to a method for modifying the rheology of a high viscous compound. In particular, the invention relates to a method for reducing viscosity of a polyethoxylated alcohol sulfate by adding diluents. The present invention also relates to compositions comprising such diluents and a polyethoxylated alcohol sulfate.

BACKGROUND OF THE INVENTION

Sodium laureth ether sulfate (SLES), also known as sodium lauryl ether sulfate, is an anionic detergent and surfactant widely used in many laundry detergent products and personal care products. Its chemical formula is $CH_3(CH_2)_{11}(OCH_2CH_2)_nOSO_3Na$, wherein n may be 2 or 3. Commercial SLES typically has three ethoxyl groups (i.e., n=3) in the chemical formula.

SLES belongs to the genus of polyethoxylated alcohol sulfates, i.e., alkyl ether sulfates (AES) or alkyl polyethoxylate sulfates, having the following Formula (I):

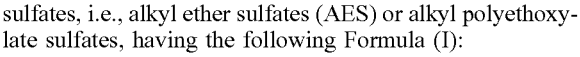

R'—O—(C2H4O)n-SO3M' (I)

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium.

SLES is an inexpensive and effective at cleaning and emulsification. However, neat (i.e., 100%) SLES is difficult to use because it has a high viscosity. Moreover, SLES is a non-Newtonian fluid, meaning that its viscosity is variable based on applied stress or force, which makes it even more difficult to handle SLES.

As such, commercial SLES is supplied as a blend of SLES (60%), ethanol (12%), water (22%), alcohol ethoxylate 3EO (5%), and sodium sulfite (1%). The addition of ethanol and other solvents into SLES reduces the viscosity of the raw material and enables it to be easily flowable and processable at manufacturing plants.

However, ethanol has a low flash point (i.e., 16.60° C.) below average room temperature. According to the industry standards, for volatile solvents (e.g., ethanol), if the flash point is below a certain value (e.g., average room temperature), the raw material has to be shipped as a hazardous material and it also needs to be stored in a "bomb-proof" room just in case it flashes and causes an explosion. The inclusion of 12 parts ethanol makes the resulting SLES/ethanol blend a potential fire hazard during shipping, handling and batching with the SLES/ethanol blend, in particular on an industrial scale.

There is a need for an improved supply of SLES which not only has an improved rheology, but has a better fire safety profile. Preferably, the SLES supply contains less low flash point solvent, compared to the current commercial SLES raw material. More preferably, the SLES supply can be easily prepared either in situ (e.g., during a process of preparing laundry detergent or personal care products) or in advance (e.g., by preparing a stock supply of SLES).

BRIEF SUMMARY OF THE INVENTION

The inventors have unexpectedly found that an ionic liquid and alcohol blend, when added into a polyethoxylated alcohol sulfate, such as sodium laureth ether sulfate (SLES), significantly reduces the viscosity of the polyethoxylated alcohol sulfate to a manageable level and enables it to be handled easily. Experimental data generated by the inventors show that this is because a synergistic effect on the viscosity reduction has occurred when an ionic liquid and an alcohol are both employed to modify the rheology of a polyethoxylated alcohol sulfate. Advantageously, the invention allows the reduction of the amount of a flammable alcohol needed to handle a polyethoxylated alcohol sulfate properly at manufacturing plants, which in turn, enables a safer material handling and final product batching.

In one aspect, the present invention provides a polyethoxylated alcohol sulfate composition which has an improved rheology. The term "an improved rheology" used herein refers to a reduced viscosity level of the polyethoxylated alcohol sulfate composition, as compared to the viscosity level of polyethoxylated alcohol sulfate. An improved rheology allows the polyethoxylated alcohol sulfate composition to be reasonably flowable and processable during manufacturing processes.

The polyethoxylated alcohol sulfate composition may consist essentially of a polyethoxylated alcohol sulfate having Formula (I), water, an alcohol, and an ionic liquid R'—O—(C2H4O)n-SO3M' (I)

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium.

According to some embodiments, the polyethoxylated alcohol sulfate is SLES in an amount ranging from about 20% to about 80%, from about 25% to about 75%, from about 30% to about 70%, from about 35% to about 65%, from about 40% to about 60%, from about 45% to about 55%, from about 40% to about 45%, or about 42%, by weight of the polyethoxylated alcohol sulfate composition. The polyethoxylated alcohol sulfate composition can thus be called SLES composition or SLES blend.

In some embodiments, water is in an amount ranging from about 5% to about 35%, from about 10% to about 30%, from about 15% to about 25%, from about 17% to about 22%, about 18%, about 19%, about 20%, or about 21%, by weight of the polyethoxylated alcohol sulfate composition.

According to some embodiments of SLES compositions, SLES may be provided initially as a premix of SLES and water, which can be called SLES premix. A preferred SLES premix consists of SLES and water in a ratio of 7:3.

It has been discovered that the addition of an ionic liquid alone to an SLES premix does not cause too much change of the rheology of SLES, and that the addition of a small amount of an alcohol alone to a SLES premix reduces the viscosity of SLES to some extent. However, when a blend of the ionic liquid and the alcohol (in small amount) is added to an SLES premix, the viscosity of SLES is reduced significantly, much greater than the sum of the viscosity reductions caused by the alcohol alone and by the ionic liquid alone.

The synergistic effect allows the use of less alcohol in the SLES composition to reduce viscosity of the SLES composition to a desired level. According to some embodiments, the alcohol is present in an amount ranging from about 1% to about 3%, from about 3% to about 6%, from about 6% to about 9%, from about 9% to about 12%, or from about 12% to about 15%, by weight of the SLES composition. According to some embodiments, the alcohol amount is not more than 12%, more preferably, not more than 6%, by weight of the SLES composition.

According to one embodiment, the alcohol may be selected from a group consisting of ethanol, isopropyl, propanol, butanol, pentanol, hexanol, heptanol, and octanol, and a mixture thereof. Preferably, the alcohol is ethanol.

According to another embodiment, the ionic liquid is selected from a group consisting of trioctyl methyl amine dioctyl sulfosuccinate, triisooctyl methyl amine C12-C13 methyl branched dodecyl sulfate, tetraoctyl amine dodecyl sulfate, N-dodecyl-N,N-dimethyl-N-hydroxyammonium dodecyleethoxysulfate, N-(dodecylamindopropyl)-N, N-dimethyl-N-carboxymethylammonium, N-(dodecylamindopropyl)-N, N-dimethyl-N-carboxymethylammonium, tris(2-hydroxyethyl) methyl-ammonium methylsulfate, and a mixture thereof. Preferably, the ionic liquid is tris(2-hydroxyethyl) methyl-ammonium methylsulfate.

According to a further embodiment, the SLES composition does not include any additional component or solvent other than SLES, water, the alcohol, and the ionic liquid. According to yet another embodiment, the SLES composition may further include one or more components selected from alcohol ethoxylate, and sodium sulfite.

According to one embodiment, the ionic liquid and the alcohol have a weight ratio ranging from about 1:5 to about 5:1, preferably, from about 2:1 to about 3:1; and more preferably, about 3:1.

According to another embodiment, an SLES premix and the ionic liquid have a weight ratio ranging from about 20:1 to about 1:1; preferably, from about 10:2 to about 10:3; and more preferably, about 10:3.

According to a further embodiment, an SLES premix and the alcohol have a weight ratio ranging from about 60:1 to about 1:1; preferably from about 10:1 to about 10:2; and more preferably, about 10:1.

According to yet another embodiment, the weight of an SLES premix and a combined weight of the alcohol and the ionic liquid have a ratio ranging from about 15:1 to about 1:1; preferably, from about 10:4 to about 10:3; and more preferably, about 10:4.

In another aspect, the present invention provides a process for preparing a polyethoxylated alcohol sulfate composition with an improved rheology. The process comprises the step of blending a polyethoxylated alcohol sulfate with an alcohol and an ionic liquid, wherein the polyethoxylated alcohol sulfate having Formula (I) and is in an amount ranging from about 20% to about 80%, from about 25% to about 75%, from about 30% to about 70%, from about 35% to about 65%, from about 40% to about 60%, from about 45% to about 55%, from about 40% to about 45%, or about 42%, by the total weight of the polyethoxylated alcohol sulfate, the alcohol, and the ionic liquid. In some embodiments, the polyethoxylated alcohol sulfate composition consists essentially of polyethoxylated alcohol sulfate composition, water, the alcohol, and the ionic liquid. In preferred embodiments, the polyethoxylated alcohol sulfate is SLES, and the resulting composition can thus be called SLES composition or SLES blend.

In some embodiments, water is in an amount ranging from about 5% to about 35%, from about 10% to about 30%, from about 15% to about 25%, from about 17% to about 22%, about 18%, about 19%, about 20%, or about 21%, by weight of the polyethoxylated alcohol sulfate composition.

According to some embodiments of SLES compositions, SLES may be provided as a premix of SLES and water, which can be called SLES premix. A preferred SLES premix consists of SLES and water in a ratio of 7:3.

According to one embodiment, the SLES composition does not include any additional component or solvent other than SLES, water, an alcohol, and an ionic liquid. According to another embodiment, the SLES composition may further include one or more components selected from alcohol ethoxylate, and sodium sulfite.

According to one embodiment, the alcohol may be selected from a group consisting of ethanol, isopropyl, propanol, butanol, pentanol, hexanol, heptanol, and octanol, and a mixture thereof. Preferably, the alcohol is ethanol.

According to some embodiments, the alcohol is present in an amount ranging from about 1% to about 3%, from about 3% to about 6%, from about 6% to about 9%, from about 9% to about 12%, or from about 12% to about 15%, by weight of the SLES composition. The alcohol amount is not more than 12%, more preferably, not more than 6%, by weight of the SLES composition.

According to another embodiment, the ionic liquid is selected from a group consisting of trioctyl methyl amine dioctyl sulfosuccinate, triisooctyl methyl amine C12-C13 methyl branched dodecyl sulfate, tetraoctyl amine dodecyl sulfate, N-dodecyl-N,N-dimethyl-N-hydroxyammonium dodecyleethoxysulfate, N-(dodecylamindopropyl)-N, N-dimethyl-N-carboxymethylammonium, N-(dodecylamindopropyl)-N, N-dimethyl-N-carboxymethylammonium, tris(2-hydroxyethyl) methyl-ammonium methylsulfate, and a mixture thereof. Preferably, the ionic liquid is tris(2-hydroxyethyl) methyl-ammonium methylsulfate.

According to one embodiment, the ionic liquid and the alcohol have a weight ratio ranging from about 1:5 to about 5:1, preferably, from about 2:1 to about 3:1; and more preferably, of about 3:1.

According to another embodiment, a SLES premix SLES and the ionic liquid have a weight ratio ranging from about 20:1 to about 1:1; preferably, from about 10:2 to about 10:3; and more preferably, of about 10:3.

According to a further embodiment, a SLES premix and the alcohol have a weight ratio ranging from about 60:1 to about 1:1; preferably from about 10:1 to about 10:2; and more preferably, of about 10:1.

According to yet another embodiment, the weight of a SLES premix and a combined weight of the alcohol and the ionic liquid have a ratio ranging from about 15:1 to about 1:1; preferably, from about 10:4 to about 10:3; and more preferably, of about 10:4.

In some embodiments, the SLES premix is mixed with the alcohol first before mixed with the ionic liquid. In other embodiments, the ionic liquid and the alcohol are mixed first, which allows the preparation of a stock of the ionic liquid/alcohol blend if needed, before further mixed the ionic liquid/alcohol blend with the SLES premix.

In a further aspect, the present invention provides a detergent product by incorporating the polyethoxylated alcohol sulfate composition with an improved rheology, as described previously.

The detergent composition comprises:

(a) at least one nonionic surfactant, such as an alcohol ethoxylate, in an amount of about 10% to about 30%, about 15% to about 25%, or about 20% to about 25%, by weight of the detergent composition;

(b) a polyethoxylated alcohol sulfate blend, such as an SLES blend, and optionally another anionic surfactant, in an amount of about 8% to about 28%, about 12% to about 25%, about 15% to about 22%, or about 18% to about 22%, by weight of the detergent composition; wherein the polyethoxylated alcohol sulfate blend consists essentially of a polyethoxylated alcohol sulfate, an alcohol, water, and an ionic liquid, as described previously.

(c) a non-aqueous solvent system in an amount of about 8% to about 40%, about 15% to about 35%, or about 18% to about 30%, by weight of the detergent composition; and (d) water in an amount of about 8% to about 20%, about 12% to about 25%, about 15% to about 22%, or about 18% to about 22%, by weight of the detergent composition.

In some embodiments, the components of the SLES blend and the relative weight ratios thereof, are the same as the SLES composition, which have been described previously. Thus, detailed information will not be repeated.

In other embodiments, the detergent composition further comprises a polyol, an enzyme, a fatty acid, a fragrance composition, a color care agent, a polymer dispersant agent, an anti-disposition agent, a softening agent, or a combination thereof.

The detergent composition may be provided as a liquid stored in a plastic bottle. It may also be enclosed in pouches made from a water-soluble polymer film to provide a unit dose form detergent product.

BRIEF DESCRIPTION OF THE DRAWINGS

FIG. 1. is a graph showing the rheology profiles of various SLES blends, as measured across a shear rate from 0.41 to 10 1/s.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

As used herein, "a," "an," or "the" means one or more unless otherwise specified.

The term "or" can be conjunctive or disjunctive.

The terms "container", "pouch", "pack", "pac", "unit dose", and "single dose" can be used interchangeably and can have one or two or multi-compartment (i.e., multi-chamber).

The terms "blend(s)" and "composition(s)" are used interchangeably.

The terms "solvent," "solvents," and "solvent system," mean a liquid or liquids used to dissolve or solvate other chemicals. In some cases, materials can also be dispersed within the solvent (i.e., Titanium Dioxide in water). In other cases, a solvent (i.e., solvent A) can initially exist as a solid and then be dissolved within solvent B, so solvent A can then act as a solvent itself (i.e., PEG 3350 in water). As used herein, the terms "solvent," "solvents," and "solvent system," do not include neutralization agents, such as, e.g., triethanolamine, monoethanolamine, and sodium hydroxide.

The term in a singular or plural form can mean both singular and plural forms. For example, "textile" or "textiles" may mean both textiles and textile; and "encapsulate" or "encapsulates" may mean both encapsulate and encapsulates.

The term "about" includes the recited number ±10%. For example, "about 10" means 9 to 11.

The phrase "substantially free of" means that a composition contains little no specified ingredient/component, such as less than about 1 wt %, 0.5 wt %, or 0.1 wt %, or below the detectable level of the specified ingredient. For example, the phrase "substantially free of a sulphate surfactant" refers to a liquid composition of the present invention that contains little or no sulphate surfactant.

As used herein, the "%" described in the present invention refers to the weight percentage unless otherwise indicated.

Unless stated otherwise, molecular weight of a polymer refers to weight average molecular weight.

The invention will now be described in details using SLES as an example.

However, a person of ordinary skill in the art would understand that, in addition to reduce viscosity of SLES, the present invention is applicable to reduce viscosity of other polyethoxylated alcohol sulfates having the formula, R'—O—(C2H4O)n-SO3M', wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium.

SLES Compositions with an Improved Rheology

In one aspect, the present invention provides an SLES composition with an improved rheology profile which allows the SLES composition to be flowable and processable, suitable for manufacturing processes.

The SLES composition in accordance with the present invention consists essentially of SLES, water, an alcohol, and an ionic liquid. SLES may be present in an amount ranging from about 20% to about 80%, from about 25% to about 75%, from about 30% to about 70%, from about 35% to about 65%, from about 40% to about 60%, from about 45% to about 55%, from about 40% to about 45%, or about 42%, by weight of the SLES composition.

In some embodiments, water is in an amount ranging from about 5% to about 35%, from about 10% to about 30%, from about 15% to about 25%, from about 17% to about 22%, about 18%, about 19%, about 20%, or about 21%, by weight of the polyethoxylated alcohol sulfate composition.

Alcohols suitable for the present invention include those that have C1 to C6 mono- or di-hydroxyl groups and are in liquid or gel, preferably liquid, form at room temperature. Preferably, the alcohol does not create environmental and/or health hazards. In some embodiments, the alcohol may be selected from a group consisting of ethanol, isopropyl, propanol, butanol, pentanol, hexanol, heptanol, and octanol, and a mixture thereof. Preferably, the alcohol is selected from a group consisting of ethanol, isopropyl, propanol, butanol, and a mixture thereof. More preferably, the alcohol is ethanol.

Ionic liquids suitable for the present invention may include those disclosed in US Patent Application Publication No. 2006/0094620, the entire teaching thereof being incorporated by reference herein. In some embodiments, the ionic liquid is selected from a group consisting of trioctyl methyl amine dioctyl sulfosuccinate, triisooctyl methyl amine C12-C13 methyl branched dodecyl sulfate, tetraoctyl amine dodecyl sulfate, N-dodecyl-N,N-dimethyl-N-hydroxyammonium dodecyleethoxysulfate, N-(dodecylamindopropyl)-N, N-dimethyl-N-carboxymethylammonium, N-(dodecylamindopropyl)-N, N-dimethyl-N-carboxymethylammonium, tris(2-hydroxyethyl) methylammonium methyl sulfate, and a mixture thereof. Preferably, the ionic liquid is tris(2-hydroxyethyl) methylammonium methylsulfate, which is available commercially from BASF under the trade name, Efka® IO 6783.

The inventors have unexpectedly noticed that, upon adding an ionic liquid to the SLES/alcohol blend, the viscosity level of SLES has been significantly reduced. It is known that a small molecule alcohol with a low boiling point (e.g., ethanol) may be used as a diluent, optionally with other solvents (e.g., water), to modify the rheology profile of SLES. For example, commercial SLES is supplied as a blend of SLES (60% wt), ethanol (12% wt), water (22% wt), alcohol ethoxylate 3EO (5% wt), and sodium sulfite (1% wt), in order to provide a flowable and processable form of SLES. The more ethanol added to SLES, the lower of the viscosity level of the resulting SLES composition.

An ionic liquid is composed of an ion active and an ionic liquid-forming counter ion. It is known that an ionic liquid is capable of delivering a fabric treating benefit, a surface treating benefit, and/or an air treating benefit. But it is not known that an ionic liquid could be used for viscosity adjustment in one way to the other. In fact, adding an ionic liquid alone to SLES fails to cause any meaningful changes to the rheology profile of SLES. It is further unknown that an ionic liquid and an alcohol, when both are added to SLES, would cause a synergistic effect on the reduction of viscosity of SLES, meaning that the resulting viscosity reduction is much greater than the sum of the viscosity reductions caused by the addition of an alcohol alone to SLES and by the addition of an ionic liquid alone to SLES.

The present invention advantageously allows the use of less alcohol in the SLES composition while still providing SLES in a form with a desirable viscosity level. Without wishing to be bound by theory, it is believe that the addition of an ionic liquid to an SLES/alcohol blend synergistically enlarges the viscosity reduction effect caused by a small amount of alcohol, leading to an overall greater viscosity reduction.

According to some embodiments, the alcohol is present in an amount ranging from about 1% to about 3%, from about 3% to about 6%, from about 6% to about 9%, from about 9% to about 12%, or from about 12% to about 15%, by weight of the SLES composition. In some embodiments, the alcohol amount is less than 12%, more preferably, less than 6%, by weight of the SLES composition.

According to some embodiments, the ionic liquid and the alcohol in the ionic liquid/alcohol blend have a weight ratio ranging from about 1:5 to about 5:1, from about 1:4 to about 4:1, from about 1:3 to about 3:1, or from about 1:2 to about 2:1. According to other embodiments, the ionic liquid and the alcohol have a weight ratio ranging from about 1:5 to about 1:4, from about 1:4 to about 1:3, from about 1:3 to about 1:2, from about 1:2 to about 1:1, from about 1:1 to about 1:2, from about 2:1 to about 3:1, from about 3:1 to about 4:1, or from about 4:1 to about 5:1. According to further embodiments, the ionic liquid and the alcohol have a weight ratio of about 1:5, about 1:4, about 1:3, about 1:2, about 1:1, about 2:1, about 3:1, about 4:1, or about 5:1; preferably, about 2:1, about 3:1.

According to some embodiments, an SLES premix and the ionic liquid have a weight ratio ranging from about 20:1 to about 1:1, from about 15:1 to about 2:1, from about 10:1 to about 3:1, about 5:1 to about 4:1, about 5:4, about 5:3, or about 5:2; preferably, about 5:3. According to other embodiments, an SLES premix and the ionic liquid have a weight ratio ranging from about 10:1 to about 10:5, from about 10:2 to about 10:4, about 10:1, or about 10:3; preferably from about 10:2 to about 10:3; and more preferably, about 10:3.

According to some embodiments, an SLES premix and the alcohol have a weight ratio ranging from about 60:1 to about 1:1, from about 50:1 to about 2:1, from about 40:1 to about 3:1, about 30:1 to about 4:1, from about 20:1 to about 5:1, from about 15:1 to about 5:1, about 10:1 to about 5:1, about 15:1, about 12.5:1, about 10:1, about 7.5:1, about 5:1; preferably from about 10:1 to about 10:2; and more preferably, about 10:1.

According to further embodiments, the weight of an SLES premix and a combined weight of the alcohol and the ionic liquid have a ratio ranging from about 15:1 to about 1:1, from about 14:1 to about 2:1, from about 13:1 to about 3:1, about 12:1 to about 4:1, from about 11:1 to about 5:1, from about 10:1 to about 6:1, about 9:1 to about 7:1. According to yet further embodiments, the weight of an SLES premix and a combined weight of the alcohol and the ionic liquid have a ratio of about 10:5, about 10:4, about 10:3, about 10:2, about 10:1; and more preferably, about 10:4.

According to a further embodiment, the SLES composition does not include any additional component or solvent other than SLES, water, the alcohol, and the ionic liquid. According to yet another embodiment, the SLES composition further includes one or more components selected from a group consisting of alcohol ethoxylate, and sodium sulfite.

Process for Preparing SLES Blends

In accordance with the present invention, a process for preparing an SLES composition with an improved rheology comprising: blending SLES with water, an alcohol and an ionic liquid.

The SLES composition is present in an amount ranging from about 20% to about 80%, from about 25% to about 75%, from about 30% to about 70%, from about 35% to about 65%, from about 40% to about 60%, from about 45% to about 55%, from about 40% to about 45%, or about 42%, by the total weight of the SLES composition, the alcohol, and the ionic liquid.

In some embodiments, water is in an amount ranging from about 5% to about 35%, from about 10% to about 30%, from about 15% to about 25%, from about 17% to about 22%, about 18%, about 19%, about 20%, or about 21%, by weight of the SLES composition.

According to some embodiments of SLES compositions, SLES may be provided as a premix of SLES and water, which can be called SLES premix. A preferred SLES premix consists of SLES and water in a ratio of 7:3.

In some embodiments, the SLES composition does not include any additional component or solvent other than SLES, water, an alcohol, and an ionic liquid. In other embodiments, the SLES composition may include one or more components selected from a group consisting of alcohol ethoxylate, and sodium sulfite.

The types and the amounts of the alcohol and the ionic liquid, including preferred embodiments and the relative weight ratios among the alcohol, the ionic liquid, and the SLES premix, that are suitable for the process are substantially the same as those described in the section, SLES COMPOSITIONS WITH AN IMPROVED RHEOLOGY. Thus, details of the formulation will not be repeated.

In some embodiments, the SLES premix is blended with the alcohol first before blended with the ionic liquid. In other embodiments, the ionic liquid and the alcohol are mixed first to prepare a stock solution of the ionic liquid/alcohol blend; the stock solution is then mixed with the SLES premix. In further embodiments, all of the components are added and mixed altogether.

The mixing step can be conducted by any conventional equipment, following conventional methods. The components may be heated to facilitate the mixing, followed by cooling. Preferably, all the components are mixed until they become homogenous.

Detergent Compositions

A further aspect of the present invention provides a detergent composition which comprises the SLES blend described herein.

In one embodiment, the detergent composition comprises:

(a) at least one nonionic surfactant, such as an alcohol ethoxylate, in an amount of about 10% to about 30%, about 15% to about 25%, or about 20% to about 25%, by weight of the detergent composition;

(b) an SLES blend, and optionally another anionic surfactant, in an amount of about 8% to about 28%, about 12% to about 25%, about 15% to about 22%, or about 18% to about 22%, by weight of the detergent composition; wherein the SLES blend consists essentially of SELS, an alcohol, water, and an ionic liquid;

(c) a non-aqueous solvent system in an amount of about 8% to about 40%, about 15% to about 35%, or about 18% to about 30%, by weight of the detergent composition; and (d) water in an amount of about 8% to about 20%, about 12% to about 25%, about 15% to about 22%, or about 18% to about 22%, by weight of the detergent composition.

Nonionic Surfactants

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the Cm-Cis primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (II):

$$R_2—(—O—C_2H_4—)_m—OH \quad (II)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Product). Other suitable AEs include Genapol® C200 (available from Clariant), which is a coco alcohol having an average degree of ethoxylation of 20.

Anionic Surfactants

In some embodiments, the anionic surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates of Formula (I), such as SLES, as described before.

In other embodiments, the anionic surfactant may be linear alkylbenzene sulfonic acid (LAS) or a salt thereof, alkyl ethoxylated sulphate, alkyl propoxy sulphate, alkyl sulphate, or a mixture thereof. Linear alkylbenzenesulfonate (LAS) is a water-soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

However, in further embodiments, the detergent compositions are substantially free of LAS.

SLES Blend

As described herein, the SLES blend consists essentially of SLES, water, an alcohol, and an ionic liquid. The types and the amounts of the components of the SLES blend and the relative weight ratios thereof, are the same as what have described in the section, SLES COMPOSITIONS WITH AN IMPROVED RHEOLOGY. Thus, details of the formulation will not be repeated.

Non-Aqueous Solvent System

Suitable non-aqueous solvents for the solvent system may include polyols, ionic liquids, glycol ethers, EO/PO block copolymers, polyethylene glycol, and mixtures thereof, which are miscible with water, in particularly in the presence of surfactants.

Optionally, Other Ingredients in the Detergent Compositions

In some embodiments, the detergent composition may comprise a cationic surfactant, an ampholytic surfactant, a zwitterionic surfactant, or mixtures thereof.

In other embodiments, the detergent composition may comprise a fatty acid. Suitable fatty acid may be any fatty acid having formula: $R_3$—C(O)OH, wherein $R_3$ is a $C_5$-$C_{21}$ linear or branched aliphatic group. Preferably, the $R_3$ is a $C_{13}$-$C_{21}$ linear or branched aliphatic group. In a preferred embodiment, the fatty acid is dodecanoic acid (also known as coconut fatty acid).

In further embodiments, the detergent composition may comprise a fragrance composition, a color care agent, a soil releasing polymer, an anti-disposition agent, a softening agent, or a combination thereof. It may also comprise a whitening agent, a brightening agent, a color/texture rejuvenating agent, a bleaching catalyst, a bleaching agent, a bleach activator, a buffer, a surfactant stabilizer, a neutralization agent, a builder, an enzyme, a dye (colorant), a dispersing agent, a defoamer, an anticorrosion agent, a deodorizing agent, a preservative, a bittering agent, and/or a biocidal agent.

Unit Dose

The detergent composition may be filled in plastic bottles to provide bottled products. It may also be enclosed in pouches to provide unit dose detergent pacs, where the pouches are formed from a water-soluble or water-dispersible film material, which fully encloses the detergent composition. The detergent composition may be in the form of a solution or a suspension, although a solution is preferred.

In some embodiments, the container comprises at least two compartments, with one compartment receiving the liquid composition and other compartment(s) receiving additional compositions. Each compartment may have the same or different compositions. The additional compositions may be liquid, solid, gel, or mixtures thereof. The water-soluble or water-dispersible film material may be selected from the group consisting of polyvinyl alcohol (PVOH), polyvinyl acetate (PVA), film forming cellulosic polymer, polyacrylic acid, polyacrylamide, polyanhydride, polysaccharide, polyvinyl pyrrolidone, polyalkylene oxide, cellulose, cellulose ether, cellulose ester, cellulose amide, polyvinyl acetate, polycarboxylic acid and salt, polyaminoacid, polyamide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, and hydroxypropyl methyl cellulose (HPMC), and a mixture thereof. In preferred embodiments, the water-soluble or water-dispersible film material is selected from polyvinyl alcohol or polyvinyl acetate.

As stated earlier, the present invention is not limited to SLES, the present invention is applicable to the reduction of viscosity of other polyethoxylated alcohol sulfates, i.e., alkyl ether sulfates (AES) or alkyl polyethoxylate sulfates, having the following formula (I):

$$R'—O—(C_2H_4O)_n-SO_3M' \quad (I)$$

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium.

Accordingly, as also described in the Brief Summary of the Invention, the present invention also provides (1) a polyethoxylated alcohol sulfate blend consisting essentially of polyethoxylated alcohol sulfate, water, an alcohol, and an ionic liquid; (2) a method for preparing the polyethoxylated alcohol sulfate blend; and (3) a detergent composition or a unit dose detergent product comprising at least one nonionic surfactant, the polyethoxylated alcohol sulfate blend, a non-aqueous solvent system, and water.

The types and the amounts of the components suitable for use in the invention covering a polyethoxylated alcohol sulfates are substantially the same as those used in the embodiments, wherein the anionic surfactant is SLES. Thus, details of the information will not be repeated. A person of ordinary skill in the art would understand the scope of the present invention covers all the embodiments, wherein SLES is simply substituted with a polyethoxylated alcohol sulfate of Formula (I). Details of the embodiments having a polyethoxylated alcohol sulfate blend with an improved rheology will not be elaborated herein because it would be substantially a repeat.

EXAMPLES

The following examples are intended to further illustrate the invention and are not intended to limit the invention in any way.

Example 1

Preparation of SLES Compositions

In order to compare differences in rheology of SLES as a result of the addition of ethanol and/or tris(2-hydroxyethyl) methyl-ammonium methylsulfate (Efka® IO 6783, in short "Efka"), SLES compositions of six formulas were prepared: Formula 1 consists of a SLES premix (SLES:water=7:3 by weight) only; Formula 2 includes 60 parts the SLES premix, 12 parts ethanol, and no ionic liquid; Formula 3 includes 60 parts the SLES premix, 12 parts Efka and no alcohol; Formula 4 includes 60 parts the SLES premix, 6 parts ethanol, and 12 parts Efka; Formula 5 includes 60 parts the SLES premix, 6 parts ethanol, and no ionic liquid; and Formula 6 includes 60 parts the SLES premix, 6 parts ethanol, and 18 parts Efka. The compositions were prepared at a laboratory scale. For each composition, except the composition of Formula 1, 60 g of the SLES premix was used.

SLES composition of Formula 1 was prepared by mixing SLES and water. SLES compositions of Formulas 2 to 6 were prepared generally as follows: 1) providing a mixing container with an overhead stirrer; 2) adding water (if applicable) to the container; 3) adding an SLES:water (7:3) premix, ethanol (if applicable) and Efka IO 6783 (if applicable), and optionally other ingredients, in the container and mixing all of the ingredients with the stirrer until a homogenous mixture is obtained. During the process, each composition was checked for clumps which were broken as required. The mixing process can be conducted at an elevated temperature to facilitate the mixing by heating the components in the container directly or indirectly (i.e., heating up the container). Finally, the SLES compositions were cooled to room temperature.

Example 2

Rheology Measurement of the SLES Compositions

Rheology measurements were conducted using an AR2000-EX Rheometer with a test method of increasing the shear rate from 0.41 to 10 l/s over 5 minutes at 20° C. with a geometry cone of 40 mm, 1:59:49 (degree:min:sec), and a truncation gap of 52 microns (cone is part number 511406.901). Viscosities (Pa·S) of the SLES Blend Formulations prepared in Example 1 were measured and reported in Table 1. "Efka" in the Tables of the application stands for Efka® IO 6783. "SLES*" in Table 1 of the application stands for a mixture of SLES and water with a ratio of 7:3.

TABLE 1

| Shear Rate (1/s) | Formula 1 SLES* only, no Ethanol or Efka | Formula 2 SLES*:Ethanol:Efka = 60:12:0 | Formula 3 SLES*:Ethanol:Efka = 60:0:12 | Formula 4 SLES*:Ethanol:Efka = 60:6:12 | Formula 5 SLES*:Ethanol:Efka = 60:6:0 | Formula 6 SLES*:Ethanol:Efka = 60:6:18 |
|---|---|---|---|---|---|---|
| | | | | Viscosity (Pa · S) | | |
| 0.41 | 95.510 | 0.429 | 62.260 | 8.160 | 55.070 | 1.340 |
| 0.75 | 49.480 | 0.294 | 35.580 | 5.406 | 28.730 | 1.257 |
| 1.08 | 32.980 | 0.232 | 24.380 | 4.248 | 18.620 | 1.210 |
| 1.41 | 24.730 | 0.221 | 18.880 | 3.624 | 13.910 | 1.180 |

TABLE 1-continued

| Shear Rate (1/s) | Formula 1 SLES* only, no Ethanol or Efka | Formula 2 SLES*:Ethanol:Efka = 60:12:0 | Formula 3 SLES*:Ethanol:Efka = 60:0:12 | Formula 4 SLES*:Ethanol:Efka = 60:6:12 | Formula 5 SLES*:Ethanol:Efka = 60:6:0 | Formula 6 SLES*:Ethanol:Efka = 60:6:18 |
|---|---|---|---|---|---|---|
| | | | | Viscosity (Pa · S) | | |
| 1.73 | 19.840 | 0.196 | 15.640 | 3.240 | 11.310 | 1.173 |
| 2.06 | 16.660 | 0.176 | 13.630 | 2.918 | 9.707 | 1.183 |
| 2.39 | 14.550 | 0.176 | 12.220 | 2.696 | 8.653 | 1.190 |
| 2.72 | 12.920 | 0.190 | 11.190 | 2.496 | 7.903 | 1.206 |
| 3.06 | 11.770 | 0.201 | 10.430 | 2.364 | 7.339 | 1.223 |
| 3.39 | 10.640 | 0.195 | 9.813 | 2.231 | 6.842 | 1.225 |
| 3.71 | 9.708 | 0.194 | 9.323 | 2.134 | 6.469 | 1.215 |
| 4.05 | 9.031 | 0.208 | 8.919 | 2.056 | 6.157 | 1.201 |
| 4.37 | 8.616 | 0.220 | 8.566 | 1.991 | 5.860 | 1.202 |
| 4.71 | 8.195 | 0.246 | 8.249 | 1.907 | 5.591 | 1.195 |
| 5.03 | 7.684 | 0.253 | 7.903 | 1.847 | 5.284 | 1.179 |
| 5.37 | 7.263 | 0.250 | 7.606 | 1.790 | 5.039 | 1.172 |
| 5.70 | 6.970 | 0.274 | 7.319 | 1.740 | 4.883 | 1.171 |
| 6.03 | 6.687 | 0.296 | 7.039 | 1.695 | 4.733 | 1.158 |
| 6.36 | 6.276 | 0.294 | 6.776 | 1.650 | 4.603 | 1.148 |
| 6.68 | 6.086 | 0.290 | 6.550 | 1.616 | 4.463 | 1.154 |
| 7.02 | 5.888 | 0.280 | 6.338 | 1.584 | 4.273 | 1.143 |
| 7.35 | 5.652 | 0.272 | 6.139 | 1.562 | 4.125 | 1.137 |
| 7.68 | 5.586 | 0.306 | 5.968 | 1.539 | 4.008 | 1.139 |
| 8.01 | 5.383 | 0.287 | 5.796 | 1.525 | 3.917 | 1.128 |
| 8.34 | 5.295 | 0.283 | 5.639 | 1.514 | 3.788 | 1.137 |
| 8.67 | 5.093 | 0.266 | 5.501 | 1.514 | 3.698 | 1.125 |
| 8.99 | 4.923 | 0.281 | 5.370 | 1.495 | 3.611 | 1.133 |
| 9.32 | 4.756 | 0.276 | 5.225 | 1.497 | 3.534 | 1.130 |
| 9.66 | 4.613 | 0.267 | 5.095 | 1.485 | 3.456 | 1.133 |
| 9.99 | 4.483 | 0.295 | 4.974 | 1.477 | 3.346 | 1.127 |

FIG. 1 is a graph showing the rheology changes of SLES as a result of the addition of ethanol and/or Efka, based on the data of Table 1.

As shown in FIG. 1, the addition of ethanol reduced the viscosity of SLES, however, the extent of reduction depended on the ratio of SLES and ethanol in the composition. When the SLES:ethanol ratio was 60 parts SLES to 12 parts ethanol (Formula 2), the viscosity of the SLES blend was reduced significantly, from 32,980 cP (Formula 1) to 0.232 cP at a shear rate of 1.08 l/s. When the SLES:ethanol ratio was 60 parts SLES to 6 parts ethanol (Formula 5), the viscosity was only reduced to 18,620 cP from 32,980 cP (Formula 1) at a shear rate of 1.08 l/s.

FIG. 1 shows that the addition of an ionic liquid alone to the SLES premix did not cause too much change of the rheology of SLES. However, when the ionic liquid was added to an SLES blend having the SLES premix and ethanol, it greatly improved the rheology of SLES.

When an additional 12 parts of an ionic liquid was added to the SLES blend having SLES premix:ethanol ratio of 60 parts:6 parts, the viscosity of the SLES blend (Formula 4) dropped from 18,620 cP (Formula 5) to 4,248 cP (Formula 4) at a shear rate of 1.08 l/s, and from 3,917 cP (Formula 5) to 1,525 cP (Formula 4) at a shear rate of 8.01 l/s. The rheology of the SLES:ethanol:Efka (60:6:12) blend shows a curved line, having a high viscosity initially at a lower shear rate and dropping to a low and nearly the same viscosity at a medium to high shear rate, which is a manageable level from a process point of view.

When an additional 18 parts of an ionic liquid was added to the SLES blend having an SLES premix:ethanol ratio of 60 parts:6 parts, the viscosity of the SLES blend (Formula 6) further dropped to 1,210 cP at a shear rate of 1.08 l/s, which is a processable at the manufacturing plants. In fact, the viscosity graph was substantially level regardless whether the viscosity was measured from a low shear rate to a high shear rate. The viscosity graph of the SLES premix:ethanol:Efka (60:6:18) blend was parallel to that of the SLES premix:ethanol (60:12) blend, which shows that the SLES premix:ethanol:Efka (60:6:18) blend is potentially a good replacement of the SLES premix:ethanol (60:12) blend during manufacturing process for supply of SLES.

The rheology of compositions of Formulas 4 and 6 showed a clear trend that the more Efka added to the SLES blend, the lower viscosity of the SLES blend. Additionally, less ethanol is required to reduce viscosity of the SLES composition if Efka is added.

FIG. 1 shows that there existed a synergic effect in lowering the viscosity level of SLES as a resulting of adding both ethanol and Efka. When only Efka (12 parts) is added to the SLES premix, the rheology of the resulting composition of Formula 3 is substantially the same as that of the composition of Formula 1. When only ethanol (6 parts) is added to the SLES premix, the rheology of the resulting composition of Formula 5 only improves modestly. However, when both Efka (12 parts) and ethanol (6 parts) were added to the SLES premix, the rheology of the resulting composition of Formula 4 showed a significant improvement compared to that of the composition of Formula 1.

Example 3

Preparation of Laundry Detergent Compositions Comprising SLES

Laundry detergent compositions using the SLES blend, as set forth in Table 2, were prepared by following conventional methods of preparation. Instead of using neat SLES or an SLES premix, a flowable and processable SLES blend was used during the manufacturing process, as indicated in Table 2.

| Description | Composition 1 (% wt) | Composition 2 (% wt) | Composition 3 (% wt) |
|---|---|---|---|
| C12-C15 Alcohol Ethoxylate 7EO | 23.1 | 23.1 | 23.1 |
| PEG 400 | 18.5 | 18.5 | 18.5 |
| SLES Blend (60 parts SLES premix, 12 parts ethanol) | 18.72 | 0 | 0 |
| SLES Blend (60 parts SLES premix, 6 parts ethanol, 12 parts Efka) | 0 | 20.26 | 0 |
| SLES Blend (60 parts SLES premix, 6 parts ethanol, 18 parts Efka) | 0 | 0 | 21.85 |
| Glycerine | 9 | 9 | 9 |
| Propylene Glycol | 7 | 7 | 7 |
| Bases | 1.5 | 1.5 | 1.5 |
| Fatty Acid | 4 | 4 | 4 |
| Enzymes | 1.5 | 1.5 | 1.5 |
| Other Ingredients | 1.1 | 1.1 | 1.1 |
| Water | 13.6 | 12 | 10.5 |
| Polymeric Dispersant | 2 | 2 | 2 |
| Total | 100 | 100 | 100 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A polyethoxylated alcohol sulfate blend consisting essentially of:

sodium laureth ether sulfate (SLES), ethanol, tris(2-hydroxyethyl) methyl-ammonium methyl sulfate, and water;

wherein the sodium laureth ether sulfate is present in an amount ranging from about 20% to about 80% by weight of the blend, wherein the ethanol is present with the tris(2-hydroxyethyl) methyl-ammonium methylsulfate in a weight ratio of about 6:12 to about 6:18, and wherein the blend does not include any component other than the sodium laureth ether sulfate, the water, the ethanol, and the tris(2-hydroxyethyl) methyl-ammonium methyl sulfate.

2. The polyethoxylated alcohol sulfate blend according to claim 1, wherein the sodium laureth ether sulfate (SLES) and water have a weight ratio of 7:3.

3. A detergent composition comprising the polyethoxylated alcohol sulfate blend according to claim 1.

4. The detergent composition according to claim 3, wherein the detergent composition is enclosed in a pouch made of a water-soluble polymer film.

5. The polyethoxylated alcohol sulfate blend according to claim 1, wherein the sodium laureth ether sulfate is present in an amount of about 60% by weight of the blend.

6. The polyethoxylated alcohol sulfate blend according to claim 5, wherein the ethanol is present with the tris(2-hydroxyethyl) methyl-ammonium methylsulfate in a weight ratio of about 6:12.

7. The polyethoxylated alcohol sulfate blend according to claim 5, wherein the ethanol is present with the tris(2-hydroxyethyl) methyl-ammonium methylsulfate in a weight ratio of about 6:18.

8. The polyethoxylated alcohol sulfate blend according to claim 1, wherein the ethanol is present with the tris(2-hydroxyethyl) methyl-ammonium methylsulfate in a weight ratio of about 6:12.

9. The polyethoxylated alcohol sulfate blend according to claim 1, wherein the ethanol is present with the tris(2-hydroxyethyl) methyl-ammonium methylsulfate in a weight ratio of about 6:18.

10. The detergent composition according to claim 3, wherein the sodium laureth ether sulfate is present in the blend in an amount of about 60% by weight of the blend.

11. The detergent composition according to claim 10, wherein the ethanol is present with the tris(2-hydroxyethyl) methyl-ammonium methylsulfate in a weight ratio of about 6:12.

12. The detergent composition according to claim 10, wherein the ethanol is present with the tris(2-hydroxyethyl) methyl-ammonium methylsulfate in a weight ratio of about 6:18.

13. The detergent composition according to claim 3, wherein the ethanol is present with the tris(2-hydroxyethyl) methyl-ammonium methylsulfate in a weight ratio of about 6:12.

14. The detergent composition according to claim 3, wherein the ethanol is present with the tris(2-hydroxyethyl) methyl-ammonium methylsulfate in a weight ratio of about 6:18.

15. A detergent composition comprising the polyethoxylated alcohol sulfate blend according to claim 2 that is enclosed in a pouch made of a water-soluble polymer film.

16. A detergent composition comprising the polyethoxylated alcohol sulfate blend according to claim 5 that is enclosed in a pouch made of a water-soluble polymer film.

17. A detergent composition comprising the polyethoxylated alcohol sulfate blend according to claim 6 that is enclosed in a pouch made of a water-soluble polymer film.

18. A detergent composition comprising the polyethoxylated alcohol sulfate blend according to claim 7 that is enclosed in a pouch made of a water-soluble polymer film.

19. A detergent composition comprising the polyethoxylated alcohol sulfate blend according to claim 8 that is enclosed in a pouch made of a water-soluble polymer film.

20. A detergent composition comprising the polyethoxylated alcohol sulfate blend according to claim 9 that is enclosed in a pouch made of a water-soluble polymer film.

* * * * *